US009929505B2

(12) United States Patent
Ishida et al.

(10) Patent No.: US 9,929,505 B2
(45) Date of Patent: Mar. 27, 2018

(54) CONNECTOR

(71) Applicant: Yazaki Corporation, Tokyo (JP)

(72) Inventors: Takuya Ishida, Tochigi (JP); Tomoyuki Miyakawa, Tochigi (JP); Tomohiro Akiyama, Tochigi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/667,141

(22) Filed: Aug. 2, 2017

(65) Prior Publication Data

US 2018/0040979 A1 Feb. 8, 2018

(30) Foreign Application Priority Data

Aug. 5, 2016 (JP) ..... 2016-155020

(51) Int. Cl.

| | |
|---|---|
| ***H01R 13/62*** | (2006.01) |
| ***H01R 13/629*** | (2006.01) |
| ***H01R 13/506*** | (2006.01) |
| ***H01R 13/502*** | (2006.01) |
| ***H01R 13/635*** | (2006.01) |
| *H01R 24/20* | (2011.01) |
| *H01R 107/00* | (2006.01) |

(52) U.S. Cl.

CPC ..... *H01R 13/62933* (2013.01); *H01R 13/506* (2013.01); *H01R 13/5025* (2013.01); *H01R 13/635* (2013.01); *H01R 13/62938* (2013.01); *H01R 24/20* (2013.01); *H01R 2107/00* (2013.01)

(58) Field of Classification Search

None

See application file for complete search history.

(56) References Cited

U.S. PATENT DOCUMENTS

| | | | | |
|---|---|---|---|---|
| 7,275,943 | B2 * | 10/2007 | Ohtaka | H01R 13/62938 439/157 |
| 7,419,390 | B2 * | 9/2008 | Ohtaka | H01R 13/639 439/157 |
| 7,442,058 | B2 * | 10/2008 | Ohtaka | H01R 13/6272 439/157 |
| 2015/0017825 | A1 | 1/2015 | Kamiya | |

FOREIGN PATENT DOCUMENTS

| | | |
|---|---|---|
| JP | 2013-161760 A | 8/2013 |

* cited by examiner

*Primary Examiner* — Tho D Ta

(74) *Attorney, Agent, or Firm* — Kenealy Vaidya LLP

(57) ABSTRACT

A connector includes a first connector and a second connector. The first connector includes a pair of housings and a lever that slidably joins the pair of housings relative to each other. The second connector engages with the first connector by sliding relative to the first connector in an axial direction. The pair of housings includes a supporting portion, temporary locking portions, and a guiding portion. The supporting portion is provided on one of the pair of housings and rotatably supports the lever. The temporary locking portions restrict rotation of the lever. A projection is inserted into the guiding portion. The second connector includes an abutting portion abutting on the lever. In a state where the locking of the temporary locking portion is released, the lever converts a force transmitted from the guiding portion to the projection into a reverse force and transmits the converted force to the abutting portion.

7 Claims, 18 Drawing Sheets

CONNECTOR

CROSS-REFERENCE TO RELATED APPLICATION(S)

The present application claims priority to and incorporates by reference the entire contents of Japanese Patent Application No. 2016-155020 filed in Japan on Aug. 5, 2016.

BACKGROUND OF THE INVENTION

1. Field of the Invention

The present invention relates to a connector.

2. Description of the Related Art

Conventionally, there is a known connector including a lever. As this type of connector, Japanese Patent Application Laid-open No. 2013-161760 discloses a technique of a lever-type connector including a fitting operation lever pivotably attached to a first connector housing, as a leverage member that decreases an operation force at the time of fitting operation and fitting release operation between the first connector housing and a second connector housing.

However, in the conventional connector, there is still room for improvement in reducing an operation burden of an operator at engagement of the housings. For example, the operation burden is reduced, if the connectors can be engaged without requiring a complicated work such as pivoting the lever.

SUMMARY OF THE INVENTION

An object of the present invention is to provide a connector capable of reducing operator's operation burden in engagement operation between housings of the connector.

In order to achieve the above mentioned object, a connector according to one aspect of the present invention includes a first connector including a pair of housings being provided with a cylindrical outer housing and an inner housing arranged inside the outer housing, and a lever configured to slidably join the pair of housings relative to each other, and a second connector configured to be engaged with the first connector by sliding relative to the first connector in an axial direction of the first connector, wherein the pair of housings includes a supporting portion provided on one of the pair of housings and configured to rotatably support the lever and a guiding portion that is provided on the other of the pair of housings and extends in a direction intersecting the axial direction, and into which a projection provided on the lever is inserted, the one of the pair of housings includes a temporary locking portion configured to restrict rotation of the lever by being locked onto the lever, the second connector includes an abutting portion configured to abut on the lever so as to achieve transmission of a force in the axial direction, the guiding portion transmits a force directed to the second connector applied to the other of the pair of housings, to the projection, and the lever converts the force transmitted from the guiding portion to the projection into a reverse force and transmit the converted force to the abutting portion in a state where the locking by the temporary locking portion is released.

According to another aspect of the present invention, in the connector, the temporary locking portion may include a first locking portion configured to restrict rotation of the lever in one rotation direction and a second locking portion configured to restrict rotation of the lever in the other rotation direction.

According to still another aspect of the present invention, in the connector, the abutting portion may release the locking of the temporary locking portion with the lever by abutting on the temporary locking portion and elastically deforming the temporary locking portion at a time when the first connector slides relative to the second connector in the axial direction.

According to still another aspect of the present invention, in the connector, a recess recessed toward a rotation axis side of the lever may be provided at an edge of the lever, the temporary locking portion may restrict the rotation of the lever by being locked into the recess, the abutting portion may enter the recess while releasing the locking of the temporary locking portion with the lever by abutting on the temporary locking portion and elastically deforming the temporary locking portion at the time when the first connector slides relative to the second connector in the axial direction, and the lever may abut on the abutting portion at the recess and transmit the reverse force from the recess to the abutting portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to an embodiment of the present invention will be described in detail with reference to the drawings. Note that the present invention is not limited to this embodiment. Moreover, components in the following embodiment include those that can be easily assumed by those skilled in the art, or are substantially identical.

Embodiment

Figure 1:
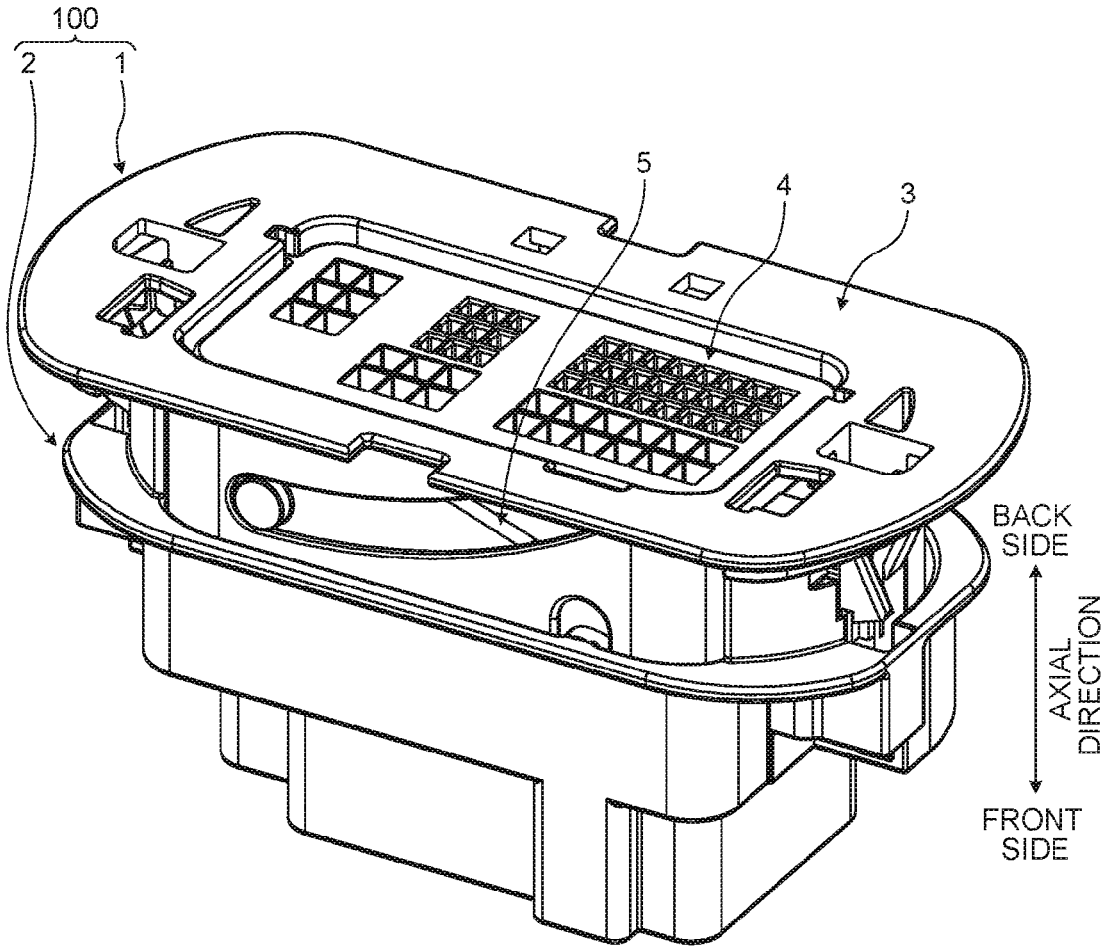
FIG. 1 is a perspective view of a connector according to an embodiment.
Figure 4:
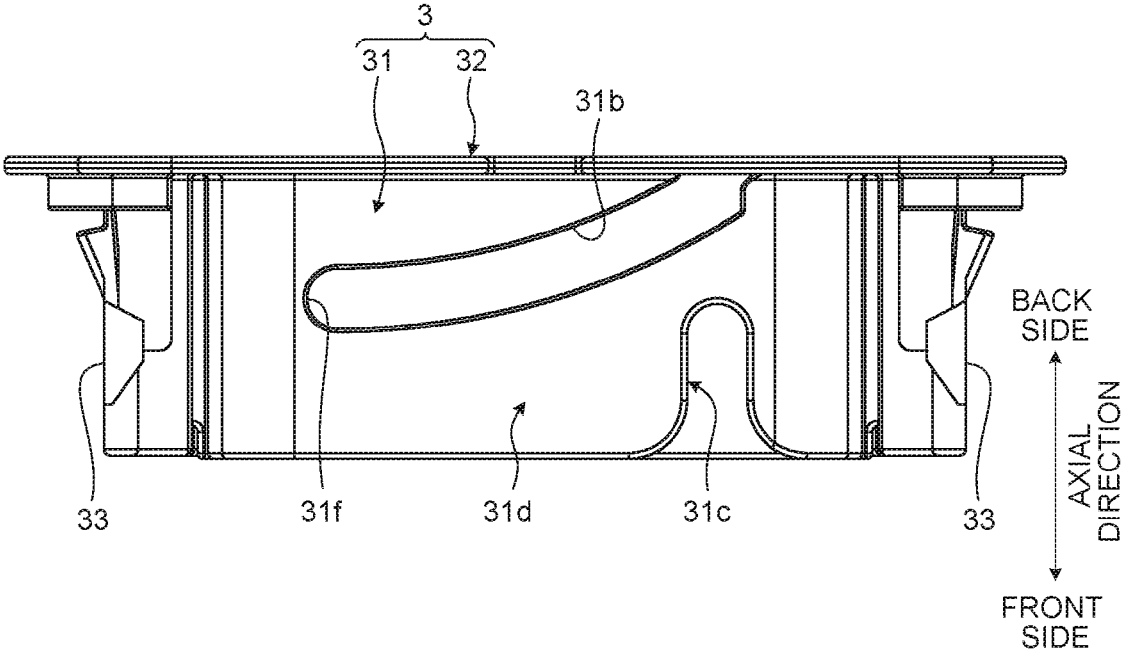
FIG. 4 is a front view of the outer housing according to the embodiment.
Figure 5:
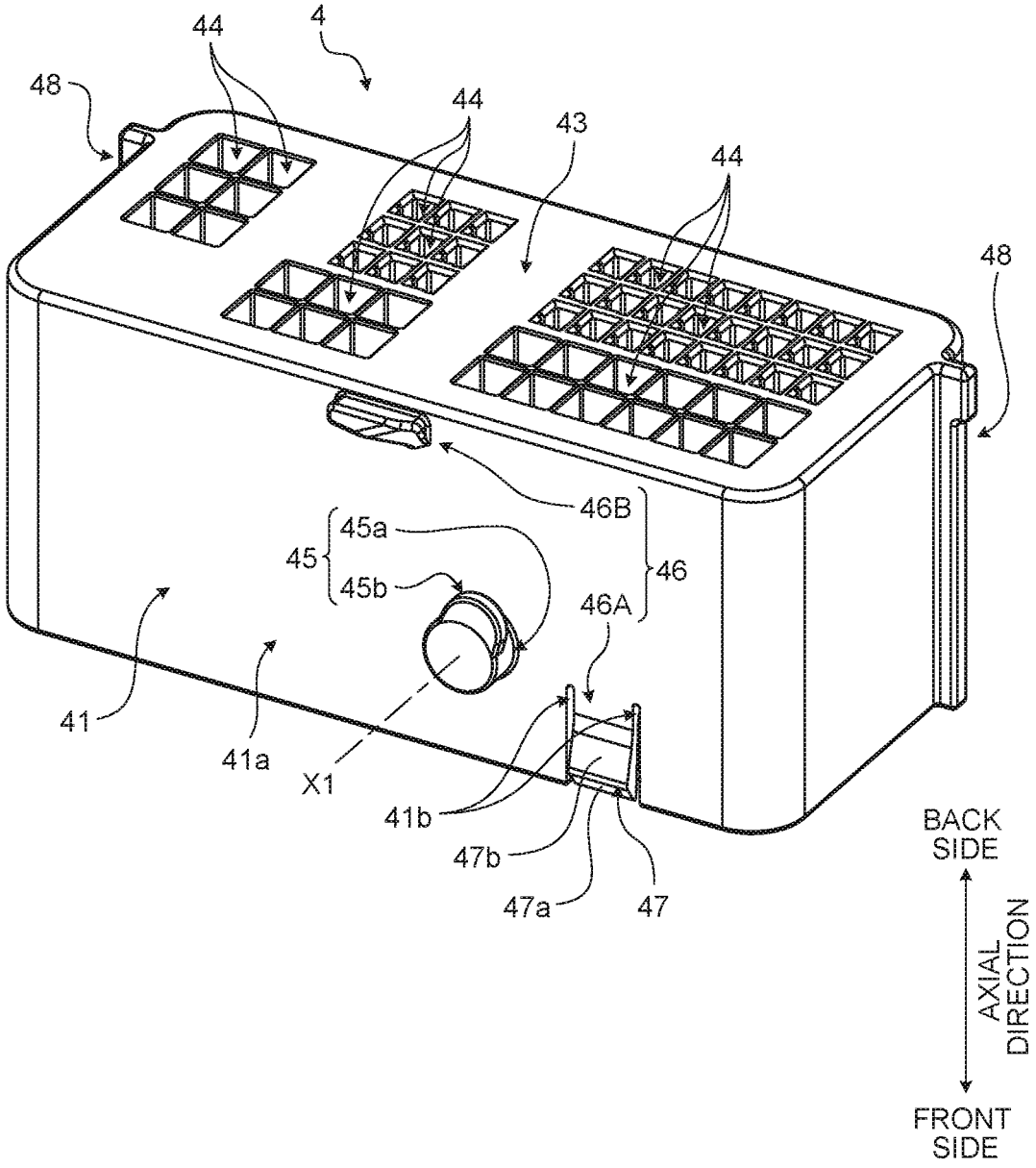
FIG. 5 is a perspective view of an inner housing according to the embodiment.
Figure 6:
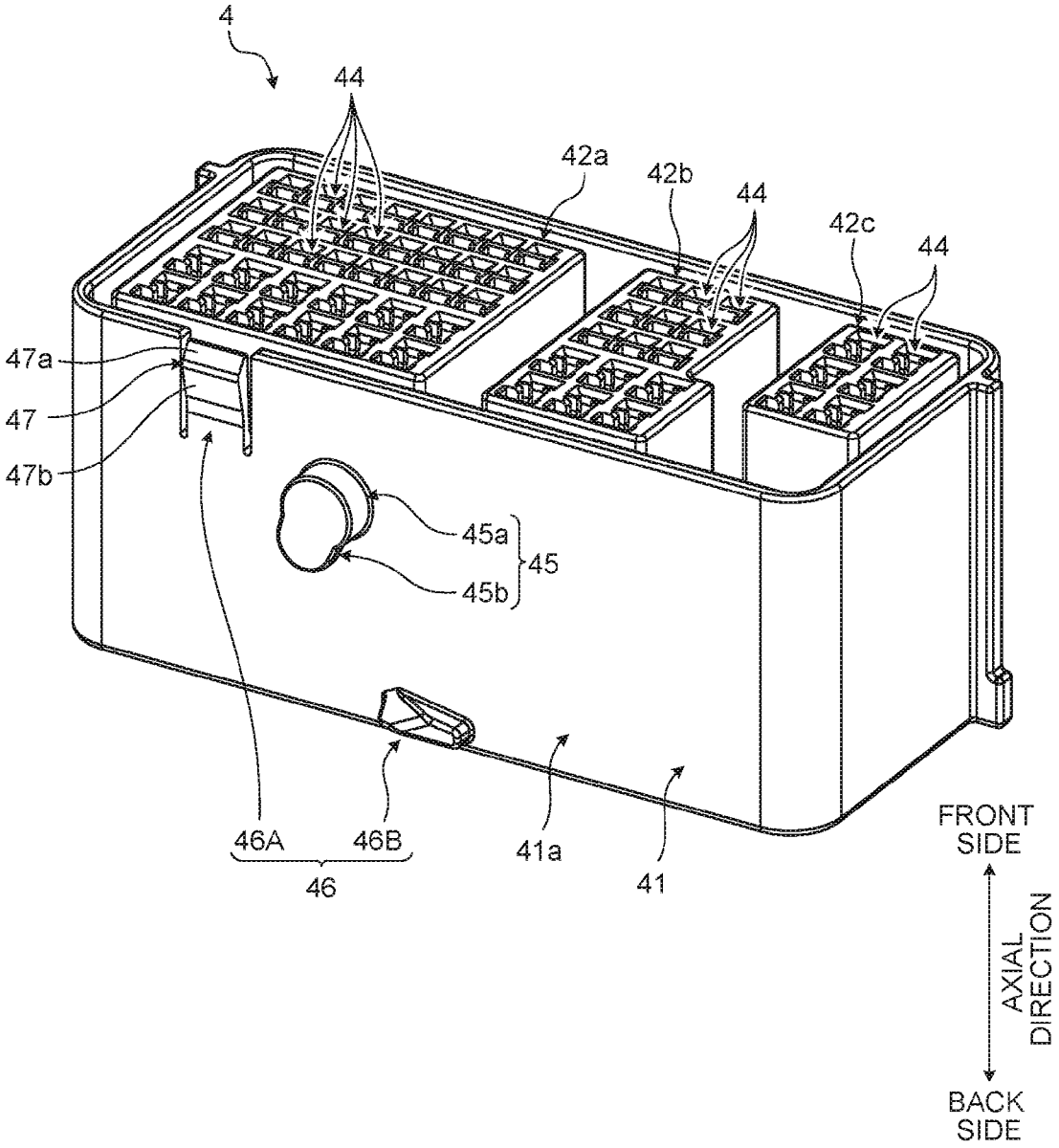
FIG. 6 is a perspective view of the inner housing according to the embodiment viewed from the back side.
Figure 7:
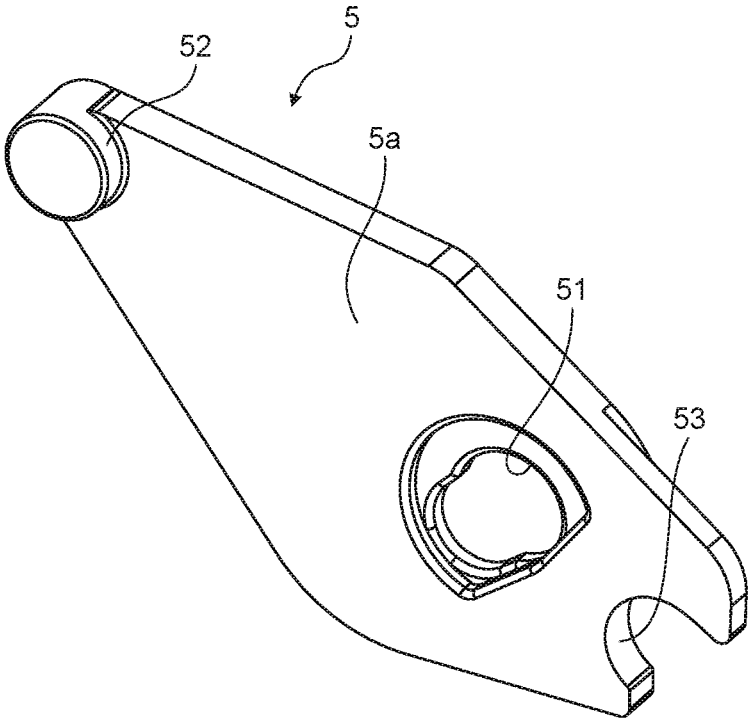
FIG. 7 is a perspective view of a lever according to the embodiment.
Figure 8:
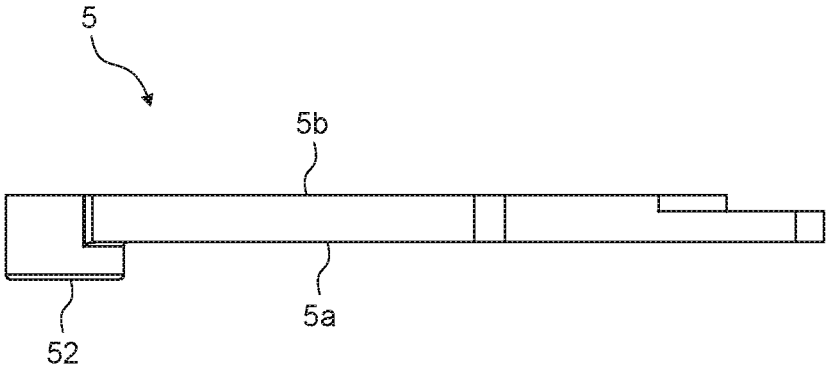
FIG. 8 is a side view of the lever according to the embodiment.
Figure 9:
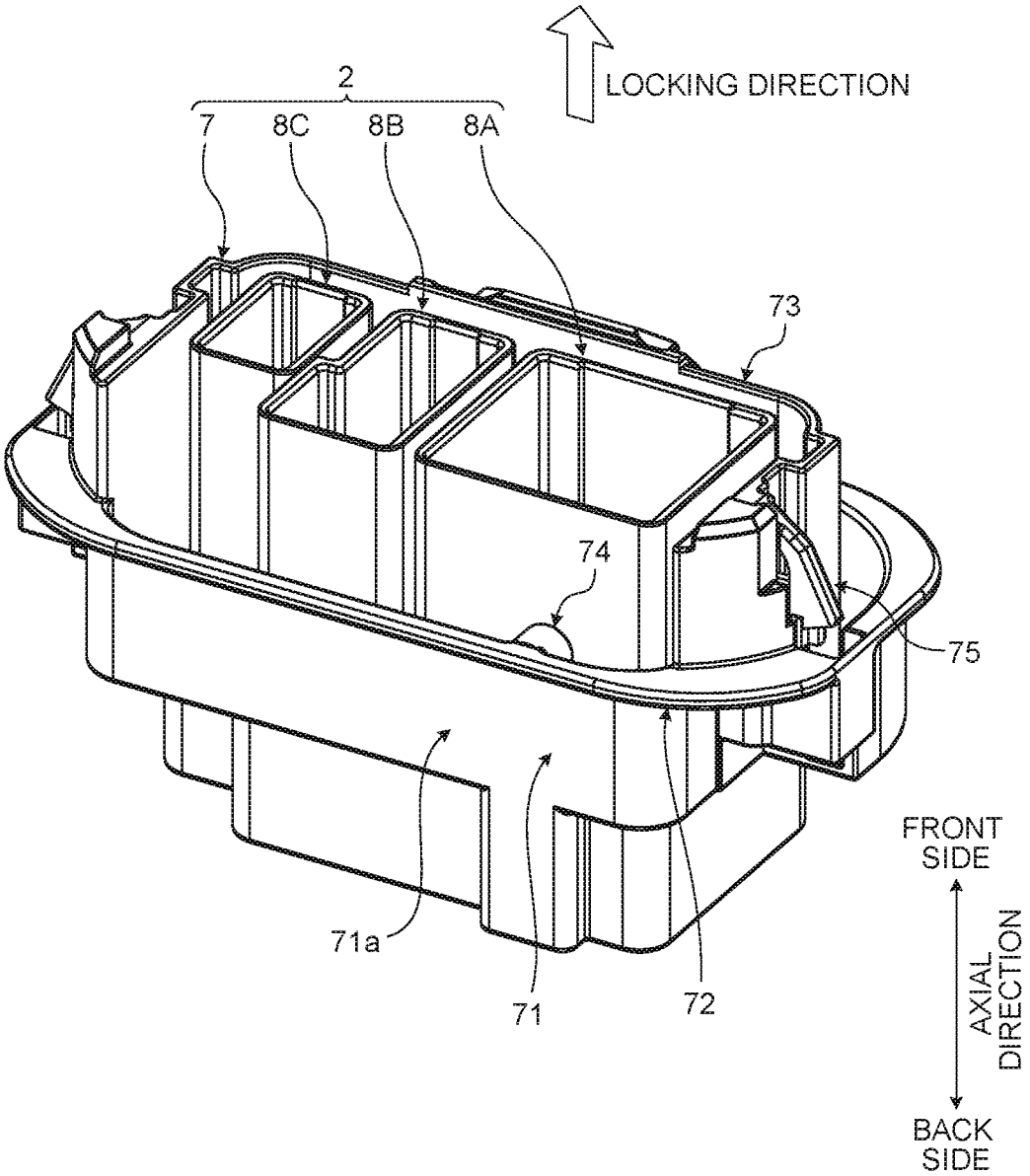
FIG. 9 is a perspective view of a second connector according to the embodiment.
Figure 10:
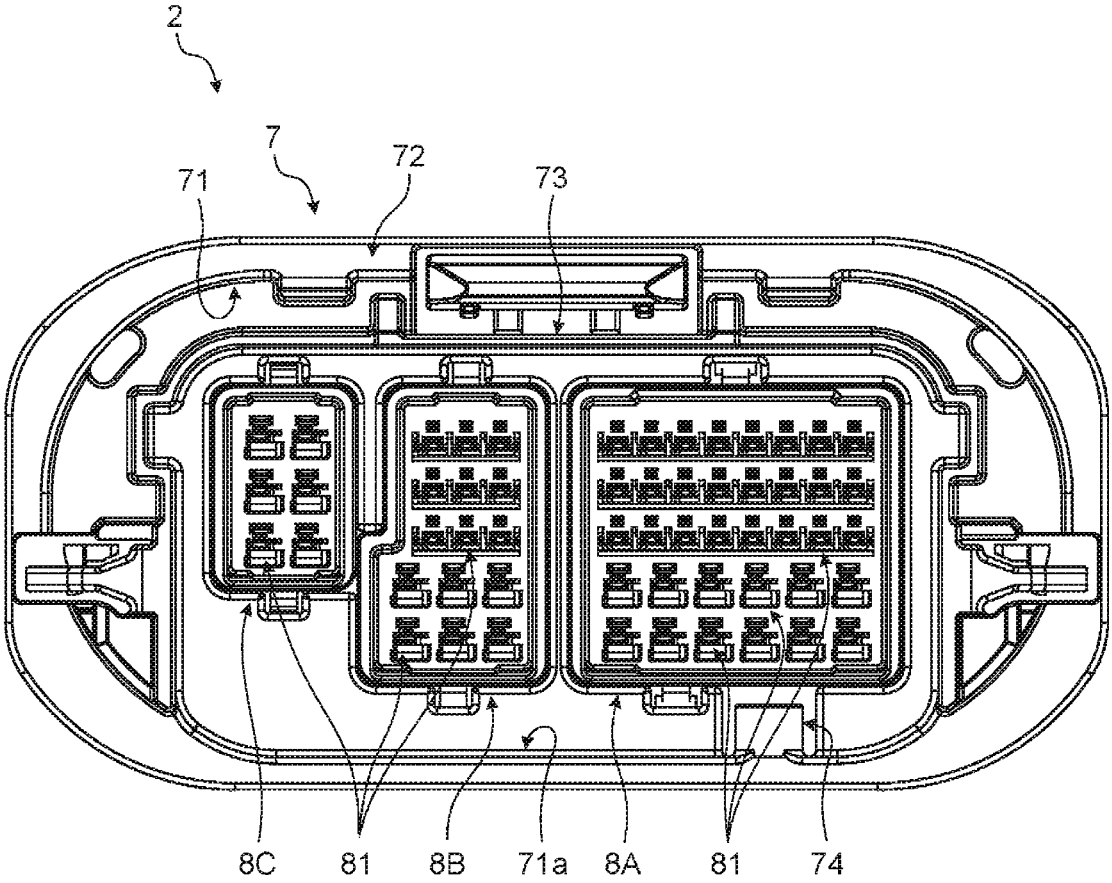
FIG. 10 is a plan view of a second connector according to the embodiment.

The embodiment is described with reference to FIGS. 1 to 18. The present embodiment relates to a connector. FIG. 1 is a perspective view of the connector according to the embodiment, FIG. 2 is a perspective view of a first connector according to the embodiment, FIG. 3 is a perspective view of an outer housing according to the embodiment, FIG. 4 is a front view of an outer housing according to the embodiment, FIG. 5 is a perspective view of an inner housing according to the embodiment, FIG. 6 is a perspective view of an inner housing according to the embodiment viewed from the back side, and FIG. 7 is a perspective view of a lever according to the embodiment, FIG. 8 is a side view of a lever according to the embodiment, FIG. 9 is a perspective view of a second connector according to the embodiment, and FIG. 10 is a plan view of a second connector according to the embodiment.

As illustrated in FIG. 1, a connector 100 according to the present embodiment includes a first connector 1 and a second connector 2. The first connector 1 and the second connector 2 are engaged with each other by relatively sliding in axial directions. The axial directions include an axial direction of an outer housing 3 and an inner housing 4 of the first connector 1 and an axial direction of the second connector 2. In the connector 100 according to the present embodiment, the second connector 2 is a so-called reception connector fixed to a panel, a wall surface, or the like. The connector 100 is used, for example, as a door connector of a vehicle. The second connector 2 is, for example, fixed to an opening provided in a body of a vehicle. The first connector 1 is connected to a device provided on a door of a vehicle. The first connector 1 is connected to the second connector 2 when the door is assembled to the body. The first connector 1 is engaged with the second connector 2 while sliding in the axial direction relative to the fixed second connector 2.

Figure 2:
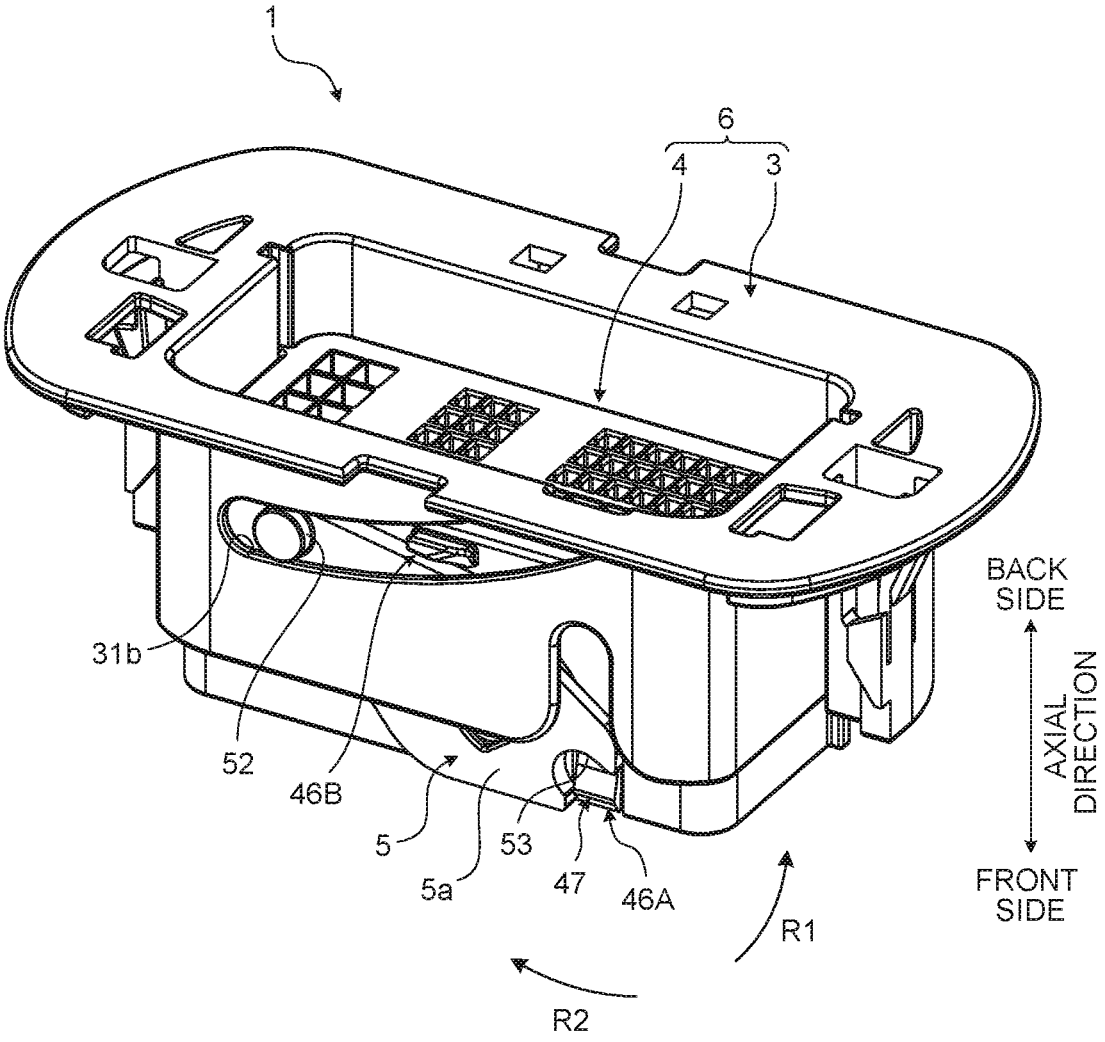
FIG. 2 is a perspective view of a first connector according to the embodiment.

As illustrated in FIG. 2, the first connector 1 includes the outer housing 3, the inner housing 4, and a lever 5. The housings 3, 4 and the lever 5 are formed of an insulating synthetic resin, for example. The outer housing 3 and the inner housing 4 form a pair of housings 6 constituting the first connector 1. The inner housing 4 is arranged inside the outer housing 3. The lever 5 slidably joins the pair of housings 6 relative to each other. Moreover, the lever 5 transmits a force in the axial direction applied to the outer housing 3 to an abutting portion 74 of the second connector 2.

Figure 3:
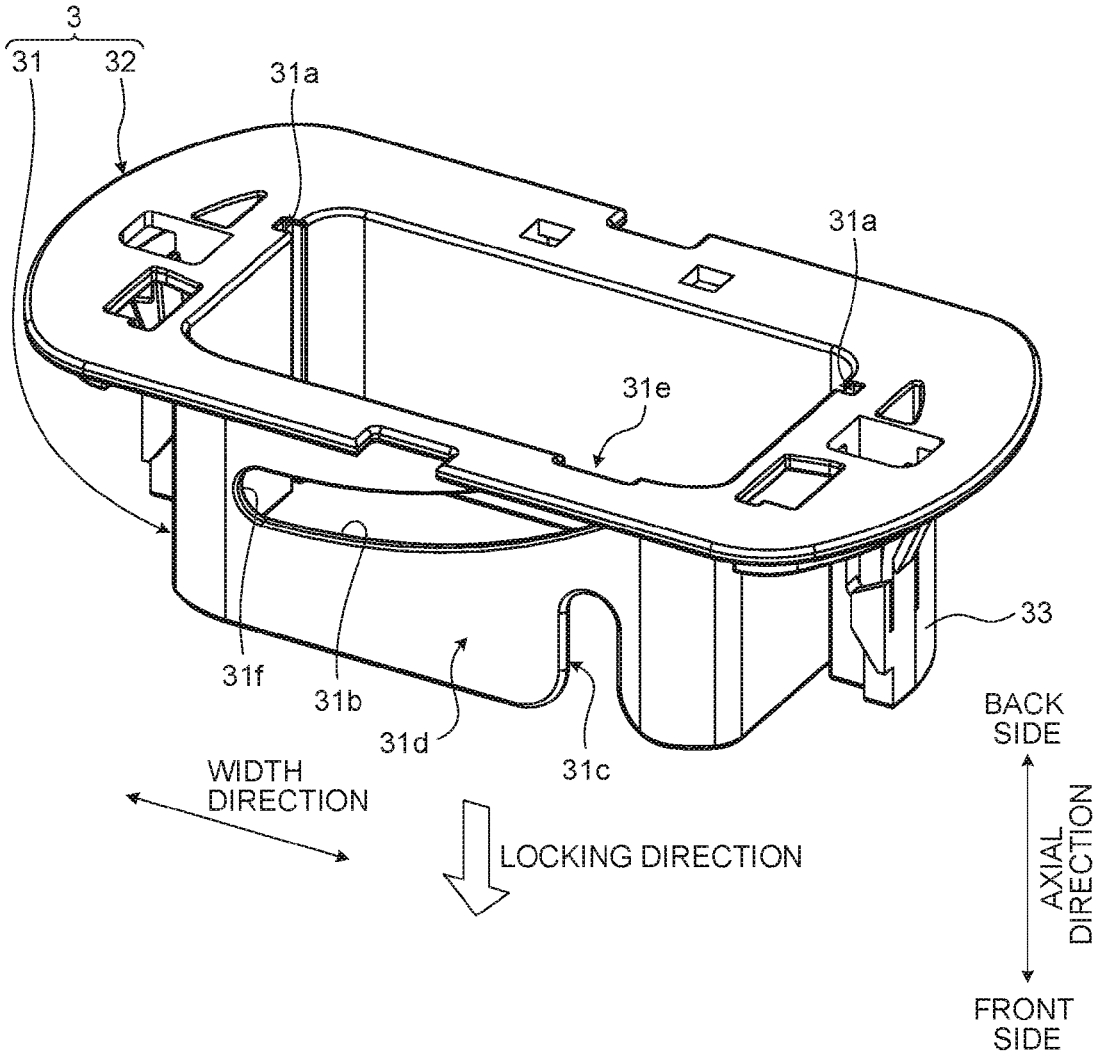
FIG. 3 is a perspective view of an outer housing according to the embodiment.

As illustrated in FIG. 3, the outer housing 3 has a cylindrical shape. More specifically, the outer housing 3 includes a cylindrical portion 31 and a flange portion 32 integrated with the cylindrical portion 31. The flange portion 32 is provided at a back end of the cylindrical portion 31 and protrudes outward from an outer surface of the cylindrical portion 31. In the cylindrical portion 31, a front end is an end disposed to face the second connector 2 when the first connector 1 is engaged with the second connector 2, and the back end is an end opposite to the front end in the axial direction. In other words, a front side with respect to the first connector 1 is a front side in a traveling direction of sliding engagement of the first connector 1 with the second connector 2.

The cylindrical portion 31 is a cylindrical component having a rectangular shape in section. An inside of the cylindrical portion 31 is hollow. The inner housing 4 is arranged inside the cylindrical portion 31 and slides in the axial direction relative to the cylindrical portion 31. The cylindrical portion 31 includes grooves 31*a* extending in the axial direction (see FIG. 3). The inner housing 4 is guided along the grooves 31*a* when moving in the axial direction relative to the cylindrical portion 31. Engaging portions 33 are provided on an outer surface of the cylindrical portion 31 (see FIG. 3). The engaging portions 33 are engaged with engaging portions 75 of the second connector 2 (see FIG. 9).

As illustrated in FIGS. 3 and 4, the cylindrical portion 31 includes a guiding portion 31*b* and a notch 31*c*. That is, the guiding portion 31*b* and the notch 31*c* are provided in the outer housing 3 which is the other of the pair of housings 6. The guiding portion 31*b* and the notch 31*c* are provided on a same side wall 31*d* of the cylindrical portion 31. A projection 52 provided on the lever 5 is inserted into the guiding portion 31*b*. The guiding portion 31*b* guides the projection 52. The guiding portion 31*b* is provided along a trajectory of the projection 52 when the outer housing 3 and the inner housing 4 move in the axial direction relative to each other. The guiding portion 31*b* is a slit provided in the side wall 31*d* and penetrates the side wall 31*d* in a thickness direction. The guiding portion 31*b* extends in a direction intersecting each of the axial direction and a width direction of the side wall 31*d*. The guiding portion 31*b* is slightly curved toward the front side in the axial direction. As illustrated in FIG. 3, one end 31*e* of the guiding portion 31*b* is a groove formed in the flange portion 32 and is open toward the back end side. The guiding portion 31*b* is provided to obliquely cross the side wall 31*d* in the width direction. That is, the one end 31*e* of the guiding portion 31*b* is positioned on one end side of the side wall 31*d* in the width direction, and another end 31*f* is positioned on the other end side of the side wall 31*d* in the width direction. The guiding portion 31*b* is inclined so as to be directed from the back side to the front side in the axial direction along a direction from the one end 31*e* to the other end 31*f*, and inclined so as to be directed from the one end side to the other end side in the width direction of the side wall 31*d*.

The notch 31*c* extends in the axial direction from the front end of the side wall 31*d* toward the back side. That is, the notch 31*c* is a recess provided on the front end side of the side wall 31*d* and is configured to recess toward the back side. The notch 31*c* serves as a passage through which the abutting portion 74 of the second connector 2 passes when the first connector 1 and the second connector 2 engages with each other while sliding relative to each other. The width of an inlet portion of the notch 31*c* increases toward the front side.

As illustrated in FIGS. 5 and 6, the inner housing 4 has a rectangular parallelepiped box shape. As illustrated in FIG. 6, the inner housing 4 includes a cylindrical portion 41, sub-connector portions 42*a*, 42*b*, and 42*c*, and a bottom wall portion 43. The cylindrical portion 41 is a cylindrical component having a rectangular cross section. The front end of the cylindrical portion 41 is open, and the back end thereof is closed by the bottom wall portion 43 as illustrated in FIG. 5. The sub-connector portions 42*a*, 42*b*, and 42*c* are prism-shaped components protruding forward from the bottom wall portion 43. The sub-connector portions 42*a*, 42*b*, and 42*c* protrude to a front side opening of the cylindrical portion 41.

Each of the sub-connector portions 42*a*, 42*b*, and 42*c* internally holds a terminal. Each of the sub-connector portions 42*a*, 42*b*, and 42*c* includes a plurality of holding holes 44 for holding the terminal. The holding hole 44 penetrates through each of the sub-connector portions 42*a*, 42*b*, and 42*c* in the axial direction and opens in the bottom wall portion 43. A female terminal is held in each of the holding holes 44. A male terminal held by the second connector 2 is inserted into the holding hole 44 from the front side and engaged with a female terminal.

The cylindrical portion 41 includes a supporting portion 45 and a temporary locking portion 46. The supporting portion 45 and the temporary locking portion 46 are provided on a same side wall 41*a* of the cylindrical portion 41. The supporting portion 45 is provided on the inner housing 4 that is one of the pair of housings 6 and rotatably supports the lever 5. The supporting portion 45 protrudes from the outer surface of the side wall 41*a*. The supporting portion 45 includes a columnar-shaped shaft portion 45*a* and a retaining portion 45*b*. The proximal end of the shaft portion 45*a* is connected to the side wall 41*a*. The retaining portion 45*b* protrudes radially outward from the distal end of the shaft portion 45*a*. The retaining portion 45*b* restricts the lever 5 from getting out of the shaft portion 45*a*.

The temporary locking portion 46 is locked onto the lever 5 and restricts the rotation of the lever 5. The temporary locking portion 46 includes a first locking portion 46A and a second locking portion 46B. The first locking portion 46A and the second locking portion 46B are arranged on different sides across the supporting portion 45 in the width direction of the side wall 41*a*. The first locking portion 46A is arranged at the front end of the side wall 41*a*. The second locking portion 46B is arranged at the back end of the side wall 41*a*. The first locking portion 46A is elastically deformable in a direction of a center axis X1 of the shaft portion 45*a*. That is, the first locking portion 46A is elastically deformable in a rotation axis direction of the lever 5 supported by the supporting portion 45. The first locking portion 46A is a plate-shaped component having a rectangular plan-view shape. The back side of the first locking portion 46A is connected to the side wall 41*a*. That is, the first locking portion 46A is a cantilever-like and plate-like component of which back end in the axial direction is supported by the side wall 41*a*. In other words, the first locking portion 46A is a portion of the side wall 41*a* and is partitioned from remaining portions of the side wall 41*a* by a pair of parallel slits 41*b*.

The first locking portion 46A includes a projection 47. The projection 47 is a protruding portion provided on the outer surface of the first locking portion 46A, and the tip of the projection 47 protrudes from an outer surface of the side wall 41*a*. The projection 47 includes a first inclined surface 47*a* and a second inclined surface 47*b*. The first inclined surface 47*a* is a front-side inclined surface of the projection 47. The first inclined surface 47*a* is an inclined surface having an outward increasing protrusion height as extending from the distal end side to the proximal end side of the first locking portion 46A. The second inclined surface 47*b* is a back-side inclined surface of the projection 47. The second inclined surface 47*b* is an inclined surface having an outward decreasing protrusion height as directing from the distal end side to the proximal end side of the first locking portion 46A.

The second locking portion 46B is a protruding portion protruding from the outer surface of the side wall 41*a*. The second locking portion 46B extends in the width direction of the side wall 41*a*. Guided portions 48 are provided on an outer surface of the cylindrical portion 41 (see FIG. 5). The guided portions 48 are ribs extending in the axial direction. The guided portions 48 are guided by the grooves 31*a* of the outer housing 3.

As illustrated in FIG. 7, the lever 5 is a plate-shaped member having a substantially rhombic plan-view shape. In other words, the width of the lever 5 is formed to narrow from the center toward both ends. The lever 5 includes a supported portion 51, a projection 52, and a recess 53. The supported portion 51 is a through hole provided in the lever 5. The supported portion 51 is provided at a position closer to the recess 53 with respect to the center of the lever 5. The supporting portion 45 of the inner housing 4 is inserted into the supported portion 51 and rotatably supports the lever 5. The projection 52 is provided at one end of the lever 5. The projection 52 has a columnar shape. As illustrated in FIGS. 7 and 8, the projection 52 protrudes from a surface 5*a* of the lever 5. The surface 5*a* is a surface of the outer housing 3 side in the lever 5. As illustrated in FIG. 2 or the like, the lever 5 is arranged in a gap between the inner housing 4 and the outer housing 3. That is, the surface 5*a* of the lever 5 faces the outer housing 3, and a back surface 5*b* faces the inner housing 4.

The recess 53 is provided at an end of the lever 5 on the side opposite to the projection 52 side. That is, the recess 53 is positioned diagonally to the projection 52 on the lever 5. The recess 53 is a recess provided at the edge of the lever 5 and is configured to recess toward the supported portion 51, that is, toward the rotation axis side of the lever 5. In other words, the recess 53 is configured to recess toward the supporting portion 45 side in a state where the supporting portion 45 is inserted into the supported portion 51. The recess 53 has a substantially semicircular shape in plan view. In other words, the recess 53 is a notch portion at which a corner of the lever 5 is cut-out in an arc shape. The recess 53 abuts onto the abutting portion 74 of the second connector 2.

As described below, the outer housing 3, the inner housing 4, and the lever 5 according to the present embodiment are assemblies assembled with each other. FIG. 2 illustrates assembled housings 3 and 4, and the lever 5. On the assembled first connector 1, the lever 5 is rotatably supported by the inner housing 4. Moreover, the projection 52 of the lever 5 is inserted into the guiding portion 31*b* of the outer housing 3. With this configuration, the inner housing 4 and the outer housing 3 are slidably joined with each other by the lever 5.

In the assembly of the first connector 1, the lever 5 is first assembled to the inner housing 4. Specifically, the operator inserts the supporting portion 45 of the inner housing 4 into the supported portion 51 of the lever 5. Furthermore, the inner housing 4 and the lever 5 are assembled to the outer housing 3. Specifically, the operator inserts the inner housing 4 and the lever 5 into the outer housing 3 from the flange portion 32 side. At this time, the projection 52 of the lever 5 is inserted into the guiding portion 31*b* of the outer housing 3 from the one end 31*e*. With this operation, the inner housing 4 and the outer housing 3 are slidably joined with each other via the lever 5.

From this state, rotation of the lever 5 is restricted by locking the first locking portion 46A onto the recess 53 of the lever 5. Specifically, an operator rotates the lever 5 to lock the first locking portion 46A onto the recess 53. The first locking portion 46A locked onto the recess 53 restricts the rotation of the lever 5. The first locking portion 46A restricts at least the rotation of the lever 5 toward a first rotation direction R1. The first rotation direction R1 is a direction of rotation of the lever 5 by the force (refer to FIG. 16) in the engagement direction applied to the outer housing 3.

In a state where the first locking portion 46A is locked onto the recess 53, the second locking portion 46B abuts on the lever 5 or is in close proximity to the lever 5 and restricts the rotation of the lever 5. The second locking portion 46B restricts the rotation of the lever 5 in a second rotation direction R2. The second rotation direction R2 is a rotation direction opposite to the first rotation direction R1. In this manner, the rotation of the lever 5 in the both directions R1 and R2 is restricted by the first locking portion 46A and the second locking portion 46B. This results in the restriction of relative movement of the outer housing 3 and the inner housing 4 in the axial direction. The state where the rotation of the lever 5 in the both directions R1 and R2 is restricted and the relative sliding of the pair of housings 6 is restricted in this manner is referred to as temporary locking of the first connector 1.

For example, the first connector 1 is transported together with the door in a temporarily locked state, and is engaged with the second connector 2 on the body side when the door is assembled to the body.

As illustrated in FIGS. 9 and 10, the second connector 2 includes a main body 7 and sub-connectors 8A, 8B, and 8C. Each of the main body 7 and the sub-connectors 8A, 8B, and 8C is made of an insulating synthetic resin, or the like. The main body 7 includes a cylindrical portion 71, a flange portion 72, and a hood 73. The cylindrical portion 71 is a cylindrical component having a rectangular cross section. The flange portion 72 is provided at a front end of the cylindrical portion 71 and protrudes outward from the outer surface of the cylindrical portion 71. On the second connector 2, the front end is the end of the side directed to the first connector 1 when the second connector 2 is engaged with the first connector 1, and the back end is the end opposite to the front end in the axial direction.

The hood 73 is provided inside the cylindrical portion 71 and is connected to the cylindrical portion 71 at the back end. The hood 73 encloses the sub-connectors 8A, 8B, and 8C from the side. The hood 73 according to the present embodiment encloses the sub-connectors 8A, 8B, and 8C from three directions excluding the abutting portion 74 side. The hood 73 includes the engaging portions 75 that engage with the engaging portions 33 of the outer housing 3.

Each of the sub-connectors 8A, 8B, and 8C is engaged with the main body 7 at each of the back ends. The sub-connectors 8A, 8B, and 8C protrude to be a more front side than the flange portion 72. As illustrated in FIG. 10, each of the sub-connectors 8A, 8B, and 8C includes a plurality of holding holes 81. Each of the holding holes 81 holds a male terminal. A portion of the male terminal protrudes to the front side from the holding hole 81. When the first connector 1 and the second connector 2 are engaged with each other, the sub-connectors 8A, 8B, and 8C are fitted with the sub-connector portions 42*a*, 42*b*, and 42*c* of the inner housing 4, respectively. More specifically, the sub-connector portions 42*a*, 42*b*, and 42*c* enter the interior of the sub-connectors 8A, 8B, and 8C, respectively. The male terminals held by the sub-connectors 8A, 8B, and 8C are electrically connected with the female terminals of the sub-connector portions 42*a*, 42*b*, and 42*c*, respectively.

As illustrated in FIGS. 9 and 10, the cylindrical portion 71 includes the abutting portion 74. The abutting portion 74 abuts on the lever 5 so as to achieve transmission of a force in an axial direction. The abutting portion 74 is provided on a side wall 71*a* of the cylindrical portion 71. More specifically, the abutting portion 74 protrudes from an inner side surface of the side wall 71*a* toward the inside of the cylindrical portion 71. The abutting portion 74 has a columnar shape. A gap corresponding to the thickness of the cylindrical portion 41 of the inner housing 4 is provided between the tip of the abutting portion 74 and the sub-connector 8A.

Figure 11:
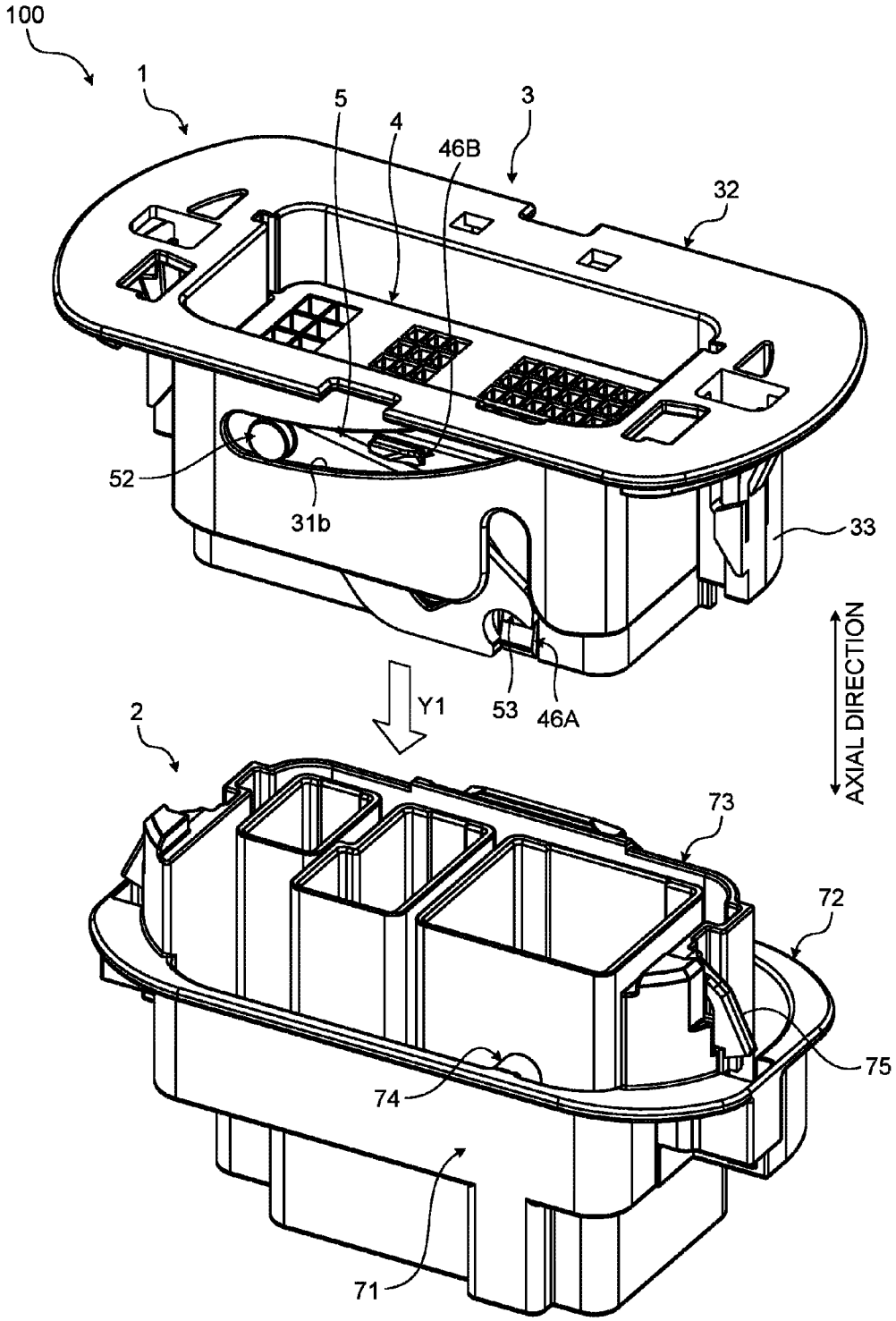
FIG. 11 is a perspective view illustrating a sliding direction in engagement operation.

As illustrated in FIG. 11, the first connector 1 is engaged with the second connector 2 while sliding in the axial direction toward the second connector 2. As indicated by arrow Y1, the operator slides the first connector 1 in the axial direction toward the second connector 2. At this time, the operator holds the first connector 1 such that the flange portion 32 is positioned at the back end. For example, the operator holds the flange portion 32 and performs operation of engaging the first connector 1 with the second connector 2. When the first connector 1 slides in the arrow Y1 direction, the inner housing 4 starts to be fitted to the sub-connectors 8A, 8B, and 8C of the second connector 2.

Figure 12:
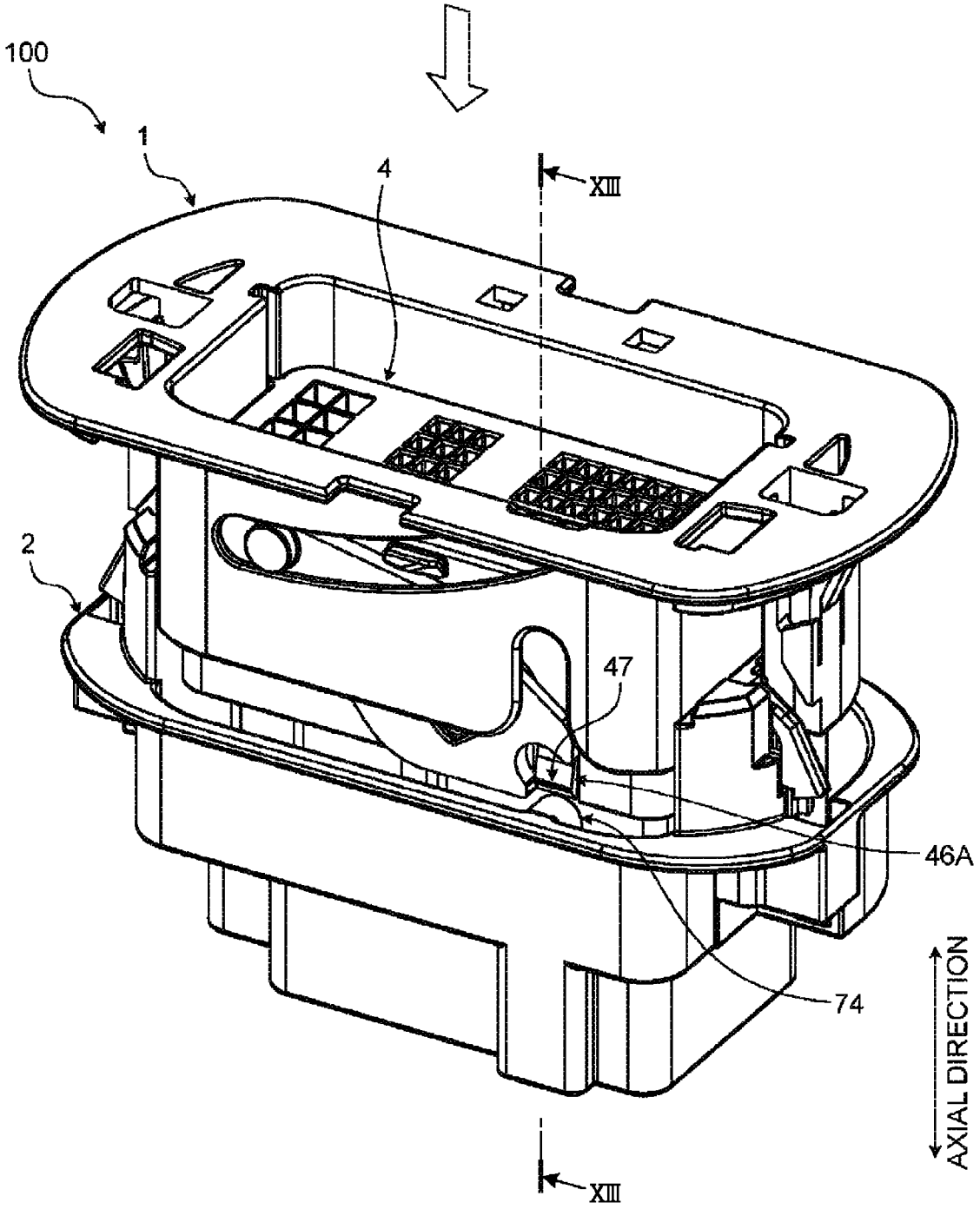
FIG. 12 is a perspective view illustrating the start of abutment between an abutting portion and a first locking portion.
Figure 13:
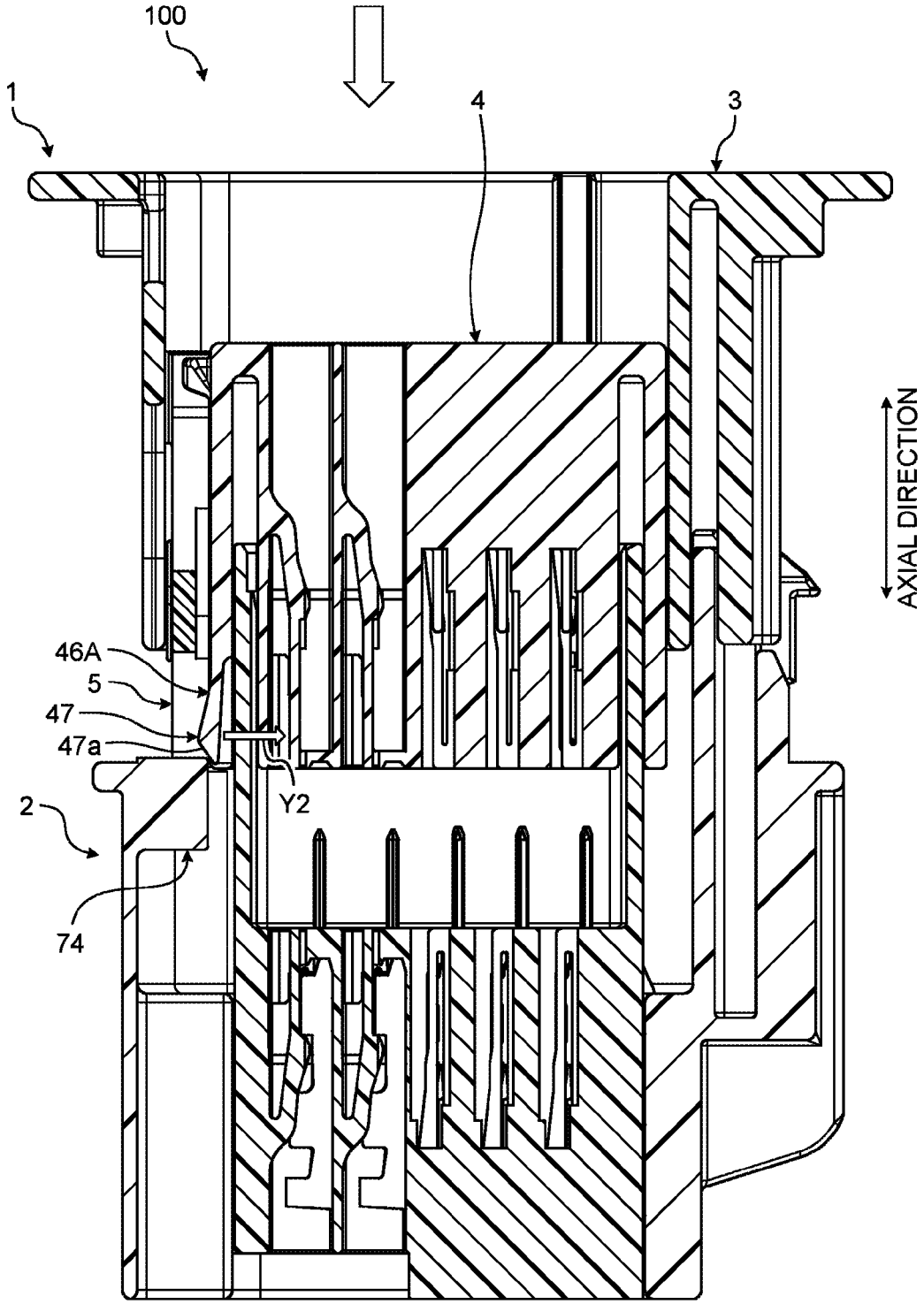
FIG. 13 is a cross-sectional view illustrating the start of abutment between the abutting portion and the first locking portion.

When the first connector 1 further slides, as illustrated in FIGS. 12 and 13, the abutting portion 74 of the second connector 2 abuts on the first locking portion 46A of the inner housing 4. Note that FIG. 13 is a cross section taken along line XIII-XIII in FIG. 12. As illustrated in FIG. 13, the abutting portion 74 abuts on the first inclined surface 47*a* of the first locking portion 46A. When the first connector 1 further slides, the abutting portion 74 elastically deforms the first locking portion 46A in a direction indicated by arrow Y2. The direction Y2 is the direction of the rotation axis of the lever 5. The abutting portion 74 presses the first locking portion 46A toward the inner side of the inner housing 4. The first locking portion 46A flexurally deformed by the abutment with the abutting portion 74 is retracted from the rotational orbit of the lever 5. That is, the locking of the first locking portion 46A with the lever 5 is released by the elastic deformation of the first locking portion 46A. This allows the rotation of the lever 5. In other words, the temporary locking between the outer housing 3 and the inner housing 4 in the first connector 1 is released.

Figure 14:
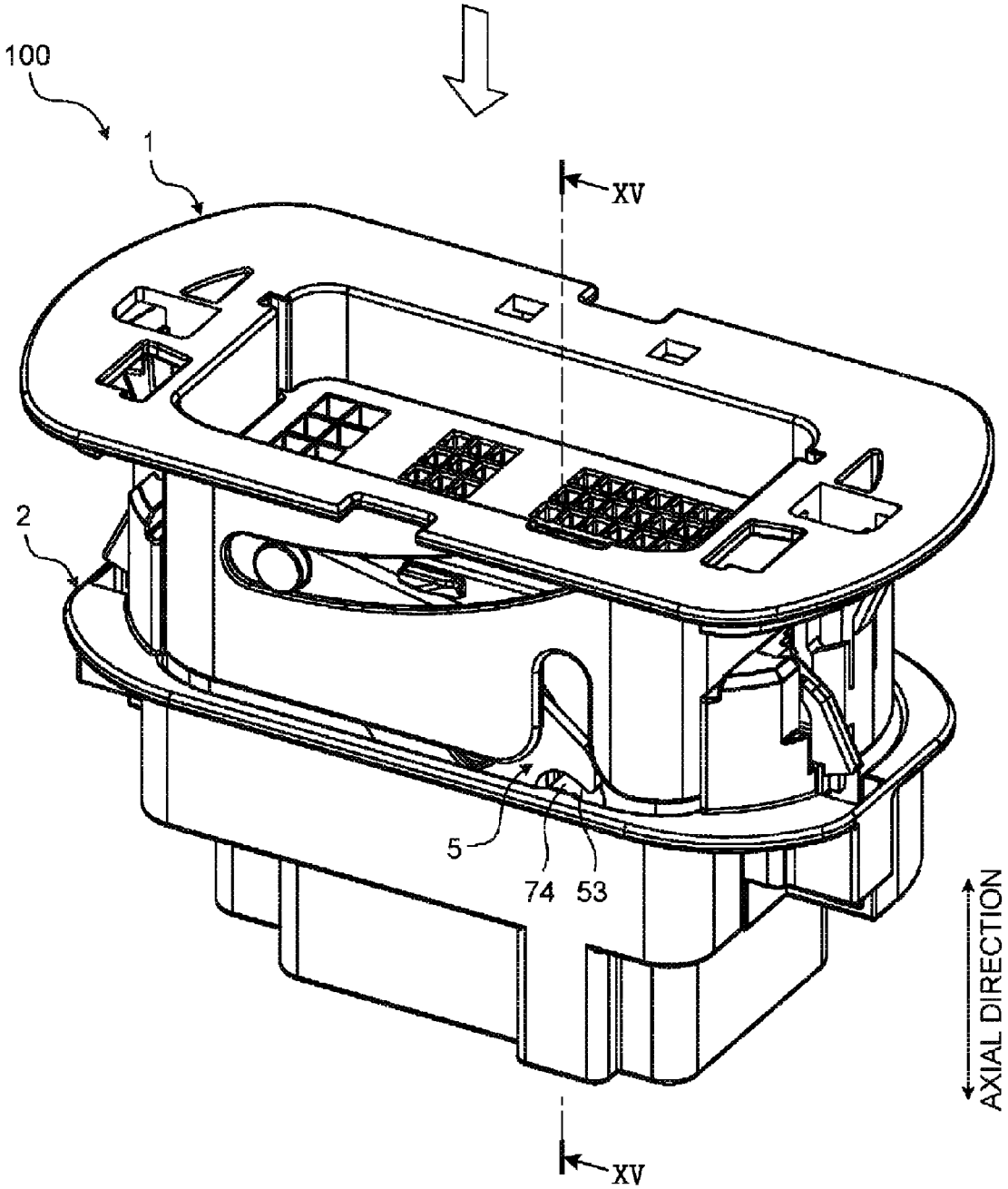
FIG. 14 is a perspective view illustrating a state where the abutting portion has entered a recess.
Figure 15:
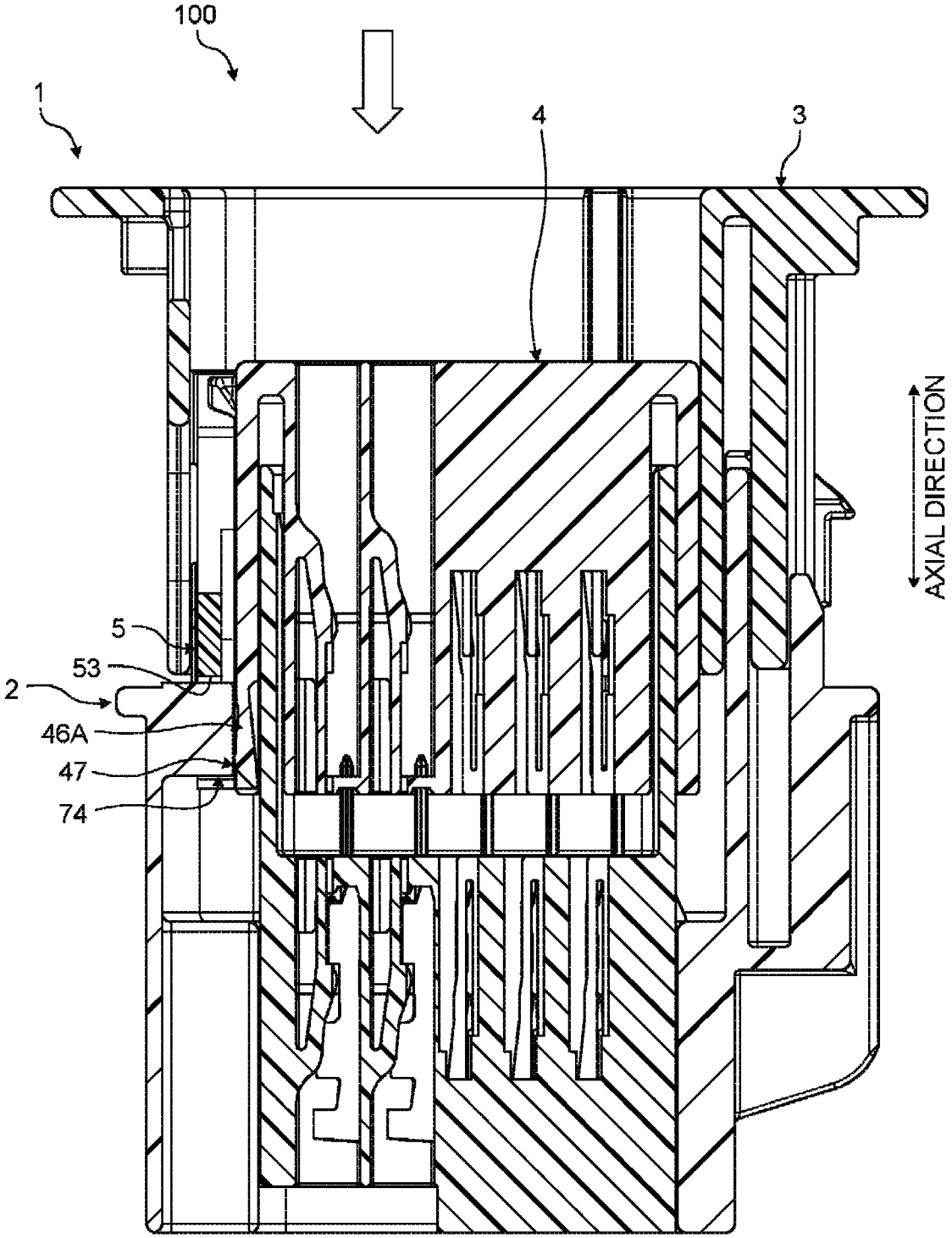
FIG. 15 is a cross-sectional view illustrating a state where the abutting portion deforms the first locking portion.

Each of FIGS. 14 and 15 illustrates a state where the abutting portion 74 releases the locking of the first locking portion 46A with the lever 5. FIG. 15 illustrates a cross section taken along line XV-XV in FIG. 14. As illustrated in FIG. 15, the abutting portion 74 rides on the projection 47 while elastically deforming the first locking portion 46A, and releases the locking of the first locking portion 46A with the lever 5. In this manner, the abutting portion 74 is entered the recess 53 of the lever 5 at a point when the temporary locking is released. More specifically, the abutting portion 74 is entered an abuttable region of the recess 53. The abuttable region is a passage region of the recess 53 at the time of rotation of the lever 5. That is, in a case where the abutting portion 74 is in the abuttable region, the recess 53 abuts on the abutting portion 74 with the rotation of the lever 5. In this manner, the abutting portion 74 according to the present embodiment enters the recess 53 of the lever 5 and becomes abuttable with the recess 53 while releasing the locking of the first locking portion 46A with the lever 5.

Figure 16:
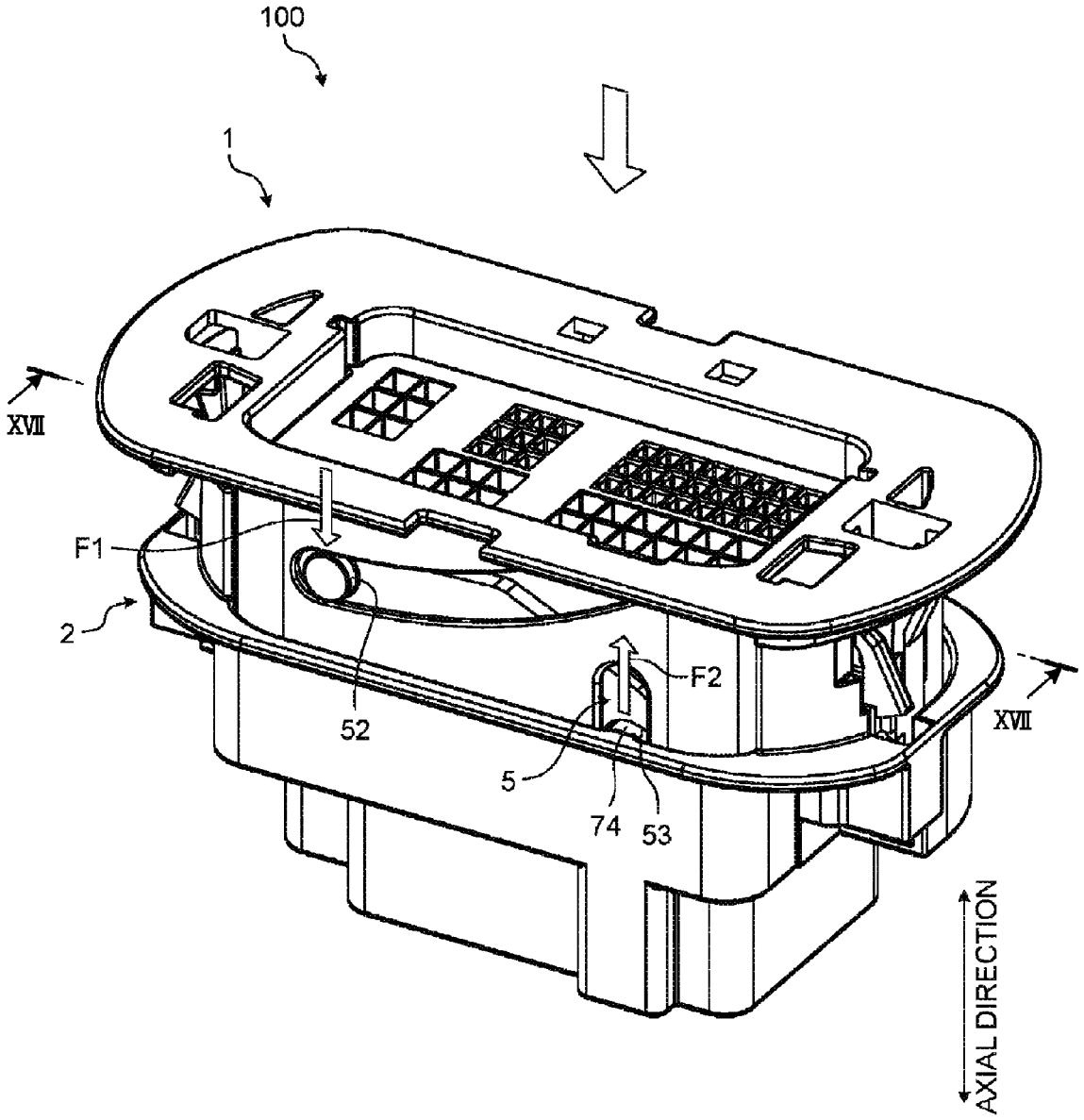
FIG. 16 is a perspective view illustrating transmission of a force by a lever.
Figure 17:
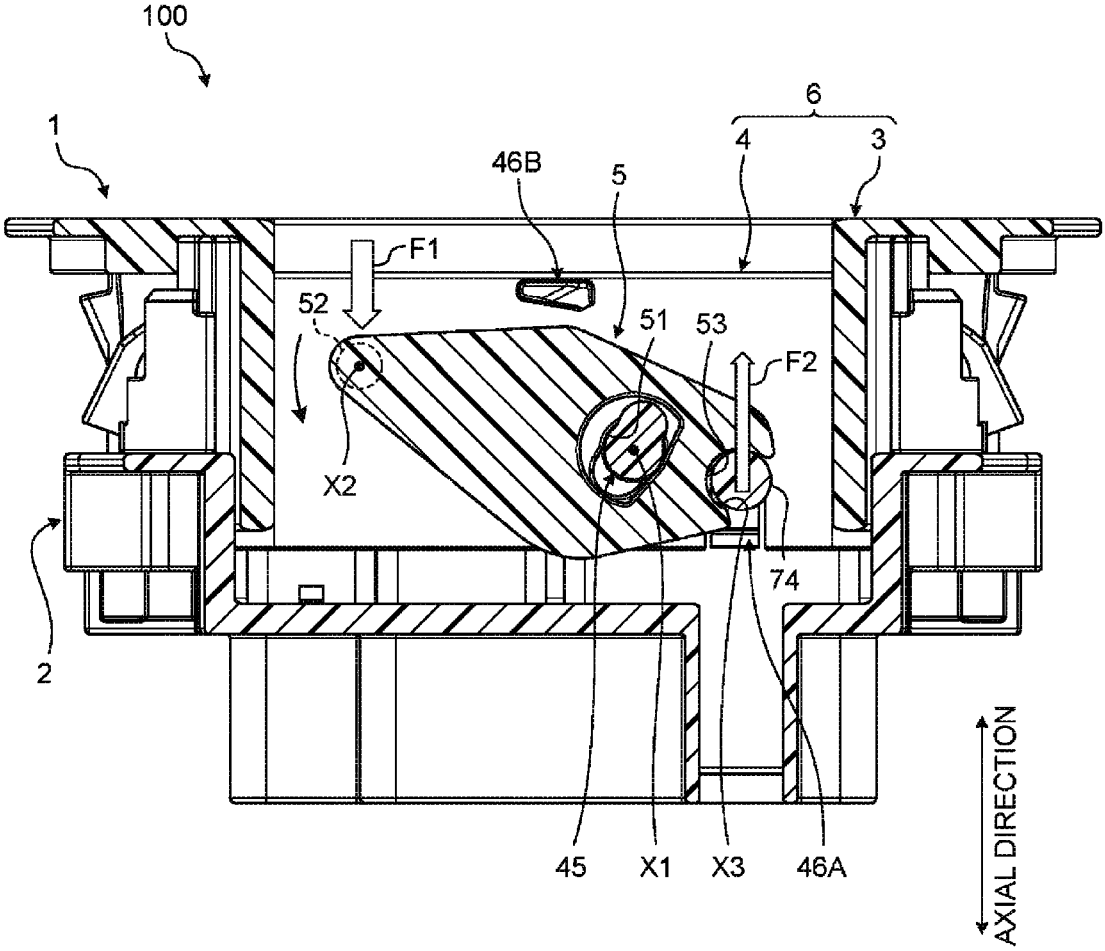
FIG. 17 is a cross-sectional view illustrating transmission of a force by a lever.

When the locking of the first locking portion 46A with the lever 5 is released, a booster mechanism functions as will be described below with reference to FIGS. 16 and 17. Each of FIGS. 16 and 17 illustrates a state where the recess 53 of the lever 5 abuts on the abutting portion 74. FIG. 17 illustrates a cross section taken along line XVII-XVII of FIG. 16. Pressing the outer housing 3 by the operator causes a force F1 in an axial direction to act on the projection 52 of the lever 5 toward the second connector 2. When the temporary locking is released, the force F1 rotates the lever 5 leading to abutment of the recess 53 with the abutting portion 74. The recess 53 that has abutted on the abutting portion 74 applies a reverse force F2 to the abutting portion 74 in the direction opposite to the force F1. The force F2 is a force in the direction opposite to the sliding direction of the first connector 1. That is, the force F1 is converted, on the lever 5, into the force F2 that pulls the second connector 2 toward the first connector 1.

Moreover, in the lever 5 according to the present embodiment, the reverse force F2 becomes greater than the force F1. As illustrated in FIG. 17, the distance from the center axis X1 of the supporting portion 45 to a center axis X2 of the projection 52 is longer than the distance from the center axis X1 to a contact portion X3 between the recess 53 and the abutting portion 74. That is, the force F2 applied by the lever 5 to the abutting portion 74 is obtained by boosting the force F1. Accordingly, the connector 100 according to the present embodiment can reduce a pressing force needed to engage the first connector 1 with the second connector 2. The necessary pressing force can be set by appropriately adjusting the relationship between the distance from the center axis X1 to the center axis X2 and the distance from the center axis X1 to the contact portion X 3.

Moreover, since the temporary locking is released and the rotation of the lever 5 is allowed, the outer housing 3 and the inner housing 4 are slidable relative to each other. When the lever 5 is rotated by the pressing force of the operator, the outer housing 3 moves in the axial direction relative to the inner housing 4 and approaches the second connector 2. Then, when the outer housing 3 and the second connector 2 are engaged with each other, the engagement between the first connector 1 and the second connector 2 is completed.

Figure 18:
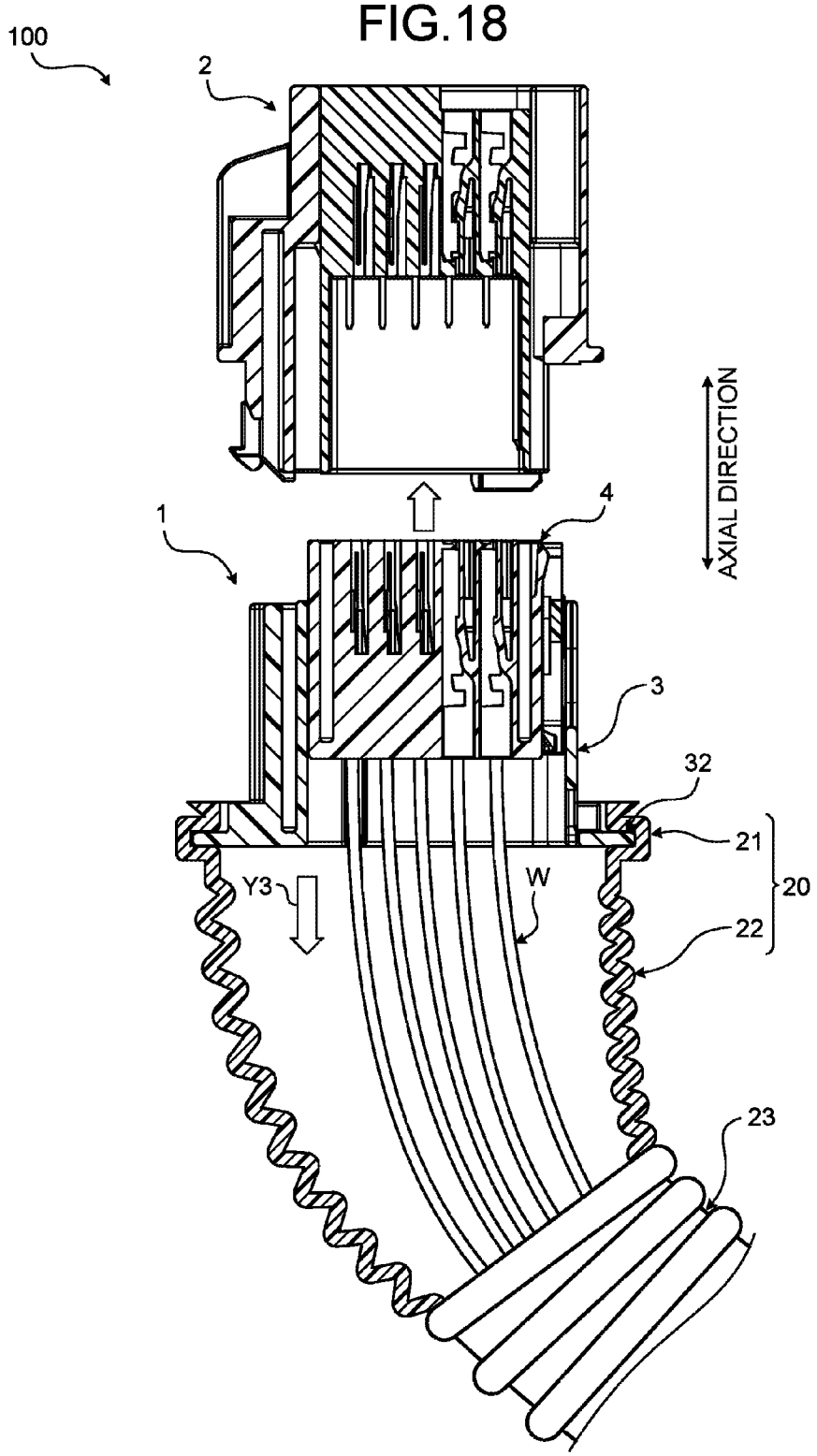
FIG. 18 is a sectional view illustrating engagement of a first connector to which a grommet is attached, with a second connector.

As will be described with reference to FIG. 18, the connector 100 according to the present embodiment allows engaging operation to be performed with a grommet 20 being attached to the first connector 1. The grommet 20 is attached to the flange portion 32 of the outer housing 3, for example. The operator holds the flange portion 32 covered with the grommet 20 and engages the first connector 1 with the second connector 2. The connector 100 according to the present embodiment allows engaging operation to be performed with the grommet 20 being covered on the first connector 1 since there is no need for the operator to operate the lever 5. For comparison, another connector is assumed, that needs, unlike the connector 100 according to the present embodiment, operator's pivoting operation of rotating the lever 5 in addition to the operation of sliding the first connector 1 in an assembly process of engaging the first connector 1 with the second connector 2. In this connector for comparison, in a case where the grommet 20 remains attached to the first connector 1, the grommet interrupts operator's operation when the operator rotates the lever 5. To avoid this, there is a need to attach the grommet 20 after completion of operation of engaging the first connector 1 with the second connector 2. In contrast, the connector 100 according to the present embodiment allows the first connector 1 to which the grommet 20 is pre-attached to be engaged with the second connector 2, thereby simplifying the assembling process.

Moreover, the grommet 20 according to the present embodiment includes a bellows portion 22. More specifically, the grommet 20 includes an attachment portion 21 and a bellows portion 22. The attachment portion 21 is a portion attached to the flange portion 32 of the first connector 1. The bellows portion 22 is formed integrally with the attachment portion 21, for example. An end of the bellows portion 22 on the side opposite to the attachment portion 21 side is connected to a pipe 23. That is, the bellows portion 22 exists between the attachment portion 21 and the pipe 23. The exemplary pipe 23 is a cylindrical protective member such as a corrugated pipe. The bellows portion 22 is a bellows-shaped covering portion and has flexibility and elasticity at least higher than the pipe 23. An electric wire W drawn out from the inner housing 4 is inserted into the pipe 23 via the bellows portion 22.

When the first connector 1 is engaged with the second connector 2, the inner housing 4 slides in the axial direction relative to the outer housing 3. This causes the electric wire W drawn out from the inner housing 4 to move in the axial direction relative to the grommet 20 as indicated by arrow Y3. The grommet 20 according to the present embodiment can respond to the movement of the electric wire W by the bellows portion 22. The bellows portion 22 follows the movement of the electric wire W by extending or bending in accordance with the movement of the electric wire W, and allows movement of the electric wire W. Accordingly, the grommet 20 can suppress restriction of movement of the electric wire W, when the first connector 1 is engaged with the second connector 2.

As described above, the first connector 1 according to the present embodiment includes the lever 5 that slidably joins the pair of housings 6 relative to each other. The pair of housings 6 includes the supporting portion 45 on one of the pair and the guiding portion 31*b* on the other of the pair. The supporting portion 45 rotatably supports the lever 5. The projection 52 of the lever 5 is inserted into the guiding portion 31*b*. Moreover, the temporary locking portion 46 that restricts the rotation of the lever 5 is provided on the one of the pair of housings 6.

The second connector 2 according to the present embodiment includes the abutting portion 74 that abuts on the lever 5 so as to achieve transmission of the force in the axial direction. The guiding portion 31*b* transmits the force F1 in the axial direction applied to the other of the pair of housings 6 toward the second connector 2 to the projection 52 of the lever 5. When the locking with the lever 5 by the temporary locking portion 46 is released, the lever 5 becomes rotatable and converts the force F1 transmitted from the guiding portion 31*b* into the reverse force F2 and transmits the force F2 to the abutting portion 74. The connector 100 according to the present embodiment can activate the booster mechanism of the lever 5 by one action of pressing the first connector 1 toward the second connector 2 in the axial direction. There is no need to perform an action of pressing the first connector 1 toward the second connector 2 in the axial direction and an action of performing pivoting operation of the lever 5 in parallel, making it is possible to reduce the operator's work burden.

The connector 100 according to the present embodiment is capable of engaging the first connector 1 with the second connector 2 while activating the booster mechanism with one action, and thus, is suitable for uses such as a door connector for a vehicle to be assembled in a narrow working space. In this assembling operation, the first connector 1 on the door side is engaged with the second connector 2 prefixed to the panel on the body side. Merely pressing the first connector 1 toward the second connector 2 leads to assistance by the booster mechanism, thereby making it possible to engage the first connector 1 with the second connector 2 with a small force.

Moreover, in the connector 100 according to the present embodiment, the rotation of the lever 5 is restricted by two portions, that is, the first locking portion 46A and the second locking portion 46B. Accordingly, the temporary locking state of the pair of housings 6 is stably maintained. Sliding between the outer housing 3 and the inner housing 4 is restricted by the temporary locking portion 46, making it possible to achieve assemblies having excellent transportability and assembling workability.

Moreover, when the first connector 1 slides toward the second connector 2 in the axial direction, the abutting portion 74 abuts on the first locking portion 46A and releases the locking of the first locking portion 46A with the lever 5 by elastically deforming the first locking portion 46A. Releasing of locking of the first locking portion 46A allows the lever 5 to rotate in the first rotation direction R1. The allowable first rotation direction R1 is a rotation direction in which the lever 5 is rotated by the force F1. This enables the lever 5 to convert the transmitted force F1 into the reverse force F2 and to transmit the force F2 to the abutting portion 74. In this manner, the abutting portion 74 not only releases the temporary locking of the lever 5, but also receives the force F2 from the lever 5 that has become rotatable, and draws the second connector 2 toward the first connector 1. The structure of the second connector 2 can be simplified by allowing the abutting portion 74 to perform a plurality of roles stepwise.

Moreover, the connector 100 according to the present embodiment includes the recess 53 at the edge of the lever 5. The recess 53 is recessed toward the rotation axis of the lever 5 (center axis X 1 of the supporting portion 45). The first locking portion 46A of the temporary locking portion 46 is locked onto the recess 53 and restricts the rotation of the lever 5. When the first connector 1 slides toward the second connector 2 in the axial direction, the abutting portion 74 abuts on the first locking portion 46A and enters the recess 53 while releasing the locking of the first locking portion 46A with the lever 5 by elastically deforming the first locking portion 46A. The lever 5 abuts on the abutting portion 74 in the recess 53 and transmits the reverse force F2 from the recess 53 to the abutting portion 74. This achieves smooth operation from the release of the temporary locking by the abutting portion 74 to the start of the operation of the booster mechanism by the lever 5.

First Modification Example of Embodiment

Figure 19:
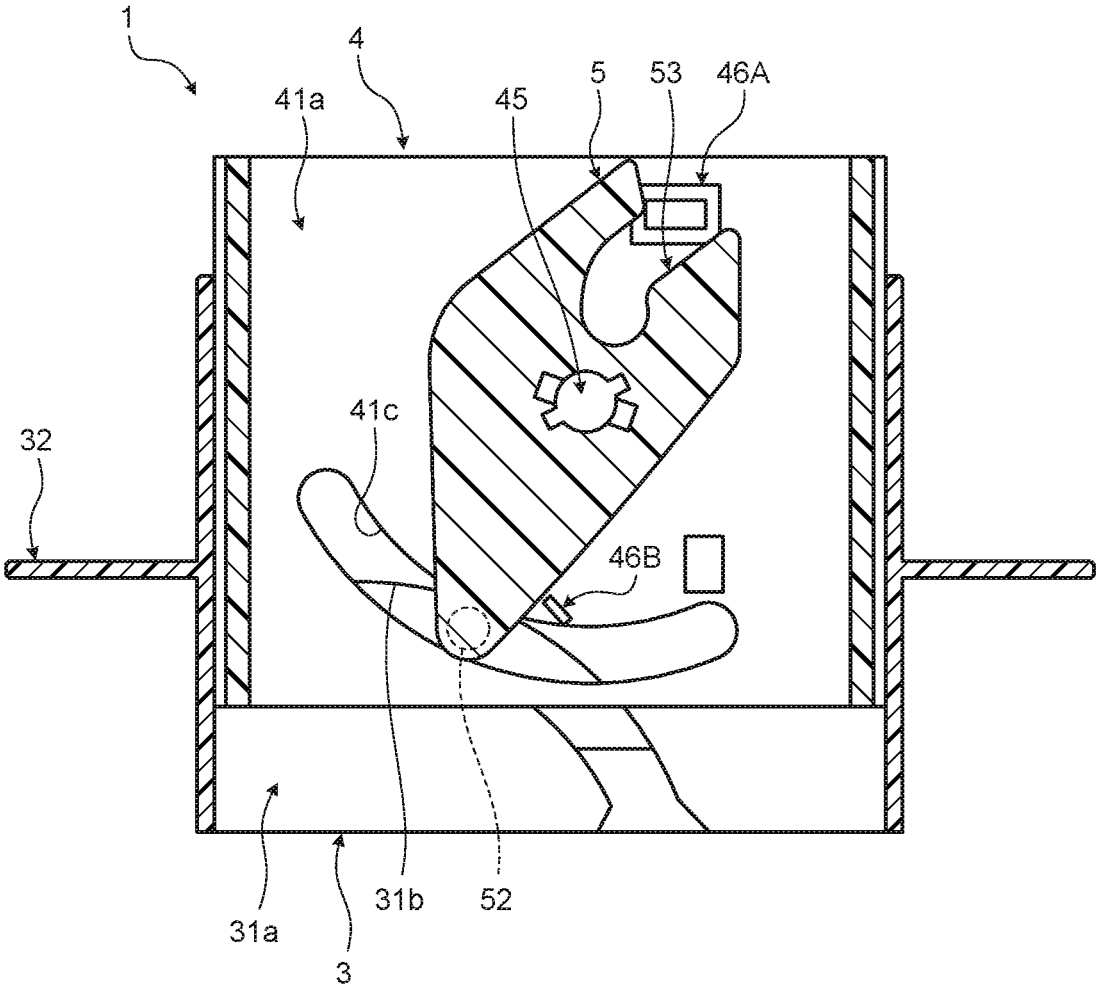
FIG. 19 is a sectional view illustrating a first connector according to a first modification example of the embodiment.

A first modification example of an embodiment will be described. FIG. 19 is a diagram illustrating a first connector according to a first modification example of an embodiment. FIG. 19 is a diagram viewed from the inside of the inner housing 4. The first connector 1 in the first modification example differs from the first connector 1 in the above-described embodiment in that the lever 5 is arranged inside the inner housing 4, for example. In the first connector 1 according to the first modification example, as illustrated in FIG. 19, the lever 5 is arranged on a side opposite to the outer housing 3 side across the side wall 41*a* of the inner housing 4. The supporting portion 45 protrudes from the side wall 41*a* toward the inside of the inner housing 4. Moreover, each of the first locking portion 46A and the second locking portion 46B protrudes inward from the side wall 41*a*.

The side wall 41*a* includes a slit 41*c*. The slit 41*c* extends along the circumference around the supporting portion 45. The projection 52 of the lever 5 is inserted into the slit 41*c* and into the guiding portion 31*b* of the outer housing 3. The slit 41*c* is provided so as to avoid interference between the side wall 41*a* and the projection 52 when the inner housing 4 and the outer housing 3 slide relative to each other. In the second connector 2 combined with the above-configured first connector 1, the abutting portion 74 is provided in the hood 73 (refer to FIG. 9), or the like. It is preferable that the abutting portion 74 protrudes outward, contrary to the abutting portion 74 of the above-described embodiment.

The lever 5 may be rotatably supported by the outer housing 3 instead of the inner housing 4. In this case, the lever 5 may be arranged between the inner housing 4 and the outer housing 3, or may be arranged outside the outer housing 3.

Second Modification Example of Embodiment

The connector 100 can also be applied as a connector other than the door connector in a vehicle. Moreover, the connector 100 may be used in other than a vehicle. In the above embodiment, the female terminal is arranged in the first connector 1, and the male terminal is arranged in the second connector 2. Conversely, the male terminal may be arranged in the first connector 1, the female terminal may be arranged in the second connector 2.

The contents disclosed in the above embodiment and modification examples can be executed in appropriate combination with each other.

A connector according to the present embodiment includes a first connector and a second connector. The first connector includes a pair of housings and a lever. The pair of housing is formed with an inner housing and an outer housing. The lever slidably joins the pair of housings relative to each other. One of the pair of housings includes a supporting portion that rotatably supports the lever and a temporary locking portion that restricts rotation of the lever. The other of the pair of housings includes a guiding portion into which a projection provided on the lever is inserted. The second connector includes an abutting portion configured to abut the lever.

In a state where the locking by the temporary locking portion is released, the lever converts the force directed to the second connector transmitted from the guiding portion to the projection into a reverse force and transmits the converted force to the abutting portion. According to the connector of the present embodiment, the reverse force transmitted to the abutting portion becomes an engaging force to engage the connector. Moreover, there is no need to perform operation of pivoting the lever. Accordingly, it is possible to achieve an effect of reducing the operation burden in engagement of the connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a first connector including a pair of housings being provided with a cylindrical outer housing and an inner housing arranged inside the outer housing, and a lever configured to slidably join the pair of housings relative to each other; and a second connector configured to be engaged with the first connector by sliding relative to the first connector in an axial direction of the first connector, wherein the pair of housings includes a supporting portion provided on one of the pair of housings and configured to rotatably support the lever, and a guiding portion that is provided on the other of the pair of housings and extends in a direction intersecting the axial direction, and into which a projection provided on the lever is inserted, the one of the pair of housings includes a temporary locking portion configured to restrict rotation of the lever by being locked onto the lever, the second connector includes an abutting portion configured to abut on the lever so as to achieve transmission of a force in the axial direction, the guiding portion transmits a force directed to the second connector applied to the other of the pair of housings, to the projection, and the lever converts the force transmitted from the guiding portion to the projection into a reverse force and transmit the converted force to the abutting portion in a state where the locking by the temporary locking portion is released.

2. The connector according to claim 1, wherein the temporary locking portion includes a first locking portion configured to restrict rotation of the lever in one rotation direction and a second locking portion configured to restrict rotation of the lever in the other rotation direction.

3. The connector according to claim 1, wherein the abutting portion releases the locking of the temporary locking portion with the lever by abutting on the temporary locking portion and elastically deforming the temporary locking portion at a time when the first connector slides relative to the second connector in the axial direction.

4. The connector according to claim 2, wherein the abutting portion releases the locking of the temporary locking portion with the lever by abutting on the temporary locking portion and elastically deforming the temporary locking portion at a time when the first connector slides relative to the second connector in the axial direction.

5. The connector according to claim 1, wherein a recess recessed toward a rotation axis side of the lever is provided at an edge of the lever, the temporary locking portion restricts the rotation of the lever by being locked into the recess, the abutting portion enters the recess while releasing the locking of the temporary locking portion with the lever by abutting on the temporary locking portion and elastically deforming the temporary locking portion at the time when the first connector slides relative to the second connector in the axial direction, and the lever abuts on the abutting portion at the recess and transmits the reverse force from the recess to the abutting portion.

6. The connector according to claim 2, wherein a recess recessed toward a rotation axis side of the lever is provided at an edge of the lever, the temporary locking portion restricts the rotation of the lever by being locked into the recess, the abutting portion enters the recess while releasing the locking of the temporary locking portion with the lever by abutting on the temporary locking portion and elastically deforming the temporary locking portion at the time when the first connector slides relative to the second connector in the axial direction, and the lever abuts on the abutting portion at the recess and transmits the reverse force from the recess to the abutting portion.

7. The connector according to claim 3, wherein a recess recessed toward a rotation axis side of the lever is provided at an edge of the lever, the temporary locking portion restricts the rotation of the lever by being locked into the recess, the abutting portion enters the recess while releasing the locking of the temporary locking portion with the lever by abutting on the temporary locking portion and elastically deforming the temporary locking portion at the time when the first connector slides relative to the second connector in the axial direction, and the lever abuts on the abutting portion at the recess and transmits the reverse force from the recess to the abutting portion.

* * * * *